US005849357A

United States Patent [19]

Andersson

[11] Patent Number: 5,849,357

[45] Date of Patent: Dec. 15, 1998

[54] METHOD OF PRODUCING A CORELESS ROLL OF FIBRE-BASED, WEB-LIKE MATERIAL

[75] Inventor: Anders Andersson, Stenungssund, Sweden

[73] Assignee: SCA Hygiene Products AB, Gothenburg, Sweden

[21] Appl. No.: 910,350

[22] Filed: Aug. 13, 1997

Related U.S. Application Data

[63] Continuation of Ser. No. 557,162, Dec. 14, 1995, abandoned.

[30] Foreign Application Priority Data

Jul. 5, 1993 [SE] Sweden ..... 9302313
Sep. 29, 1993 [SE] Sweden ..... 9303175

[51] Int. Cl.[6] ..... B65H 18/00

[52] U.S. Cl. ..... 427/179; 242/533; 242/532.3; 242/537

[58] Field of Search ..... 242/533, 532.3, 242/537; 427/179

[56] References Cited

U.S. PATENT DOCUMENTS 4,487,378 12/1984 Kobayashi ..... 242/68
4,763,785 8/1988 Bradley et al. ..... 242/159
5,407,509 4/1995 Ishizu et al. ..... 242/533

FOREIGN PATENT DOCUMENTS 0 553 493 8/1993 European Pat. Off. .
817192 10/1951 Germany .
61-27857 2/1986 Japan .
399 694 2/1978 Sweden .
419 742 8/1981 Sweden .
452 974 1/1988 Sweden .
455 367 7/1988 Sweden .

OTHER PUBLICATIONS

61–27857 Patent Abstracts of Japan (Feb. 1986).

*Primary Examiner*—Katherine K. Bareford
*Attorney, Agent, or Firm*—Young & Thompson

[57] ABSTRACT

A method of producing a coreless roll from a web of fiber-based material, comprising laying a leading end (2*a*) of a material web around a non-expandable winding-on axle (3) having a fixed diameter of at least 35 mm and rotating the axle so as to wind the web (2) onto the axle. A friction-reducing agent in the form of water is applied to the axle or to the first turn or turns of the material web, thereby to reduce friction between the web and the axle. The axle is withdrawn from the resultant roll after completion of the web winding-on process.

7 Claims, 1 Drawing Sheet

METHOD OF PRODUCING A CORELESS ROLL OF FIBRE-BASED, WEB-LIKE MATERIAL

This application is a continuation of application Ser. No. 08/557,162, filed Dec. 14, 1995, now abandoned, which is the U.S. phase of PCT/SE94/00666 filed Jul. 5, 1994, published as WO95/01929 Jan. 19, 1995, and amended Dec. 2, 1994.

TECHNICAL FIELD

The present invention relates to a method of producing a coreless roll of fiber-based, web-like material, in particular soft crêpe paper or some other nonwoven material, for instance cleaning paper, kitchen paper, or toilet paper.

BACKGROUND OF THE INVENTION

Normally, toilet paper rolls, kitchen paper rolls and cleaning paper rolls intended for large consumers are produced by winding a paper web onto a thin tubular core, normally a paperboard cylinder. This paperboard cylinder or core naturally incurs an additional cost in the manufacture of the paper roll, and since it remains when all the paper has been used it must be thrown away.

Coreless paper rolls where the paper is taken from the center of the rolls are known from SE-B-399,694, for instance. In order to avoid collapsing of the center hole, it is proposed in this publication that the inner-most paper turns are secured to one another by means of water, optionally with a binder additive. This results in a stiffening core, formed by the innermost turns although these turns are not glued together directly, but can be unrolled with the remainder of the paper web and used in the same manner as the remainder of the paper. The paper web is rolled onto an expandable winding-on axle which is contracted so as to enable it to be removed easily from the paper roll carried by the axle at the end of a winding-on process. Such an expandable axle, however, requires maintenance and can cause disturbances in operation.

SE-B-455,367 teaches a coreless toilet paper roll with which the paper can be taken from the periphery of the roll. The winding-on axle used to produce the roll has a relatively small diameter, approximately 10–15 mm, and is of polygonal cross-sectional shape. The center hole that is formed when the paper web is rolled onto the axle and the axle removed, will present alternating, radially outwardly extending compressions and inwardly arched parts. The winding-on axle is rigid, i.e. not expandable, although it can be removed easily from the paper roll, because of the small axle diameter.

THE OBJECTS AND MOST IMPORTANT CHARACTERISTIC FEATURES OF THE INVENTION

The object of the present invention is to provide a simplified method for the manufacture of a coreless roll of material, for instance a paper roll, provided with a relatively large center hole, and consequently the winding-on axle used must have a correspondingly large diameter. This accentuates the problem of removing the winding-on axle from the paper roll. This problem has been solved by means of the present invention. The inventive method is characterized by placing the leading end of the web around a non-expandable winding-on axle which has a fixed diameter of at least 35 mm and which is caused to rotate so as to wind the web onto the axle; applying a friction-reducing agent to the axle or to the first turn or turns of the web, with the intention of reducing friction between the web and the axle; and withdrawing the axle from the resultant roll, subsequent to termination of the web winding-on process.

BRIEF DESCRIPTION OF THE DRAWINGS

The present invention will now be described in more detail with reference to exemplifying embodiments thereof and also with reference to the accompanying drawings, in which.

DESCRIPTION OF EXEMPLIFYING EMBODIMENTS

The paper roll 1 is produced by moving the free end 2*a* of a paper web 2 into engagement with a winding-on axle 3 in a winding-on machine. In the case of the embodiment illustrated in FIG. 2, the web is rolled up on a so-called carrying roller machine in which the winding-on axle 3 is mounted between a pair of rotatable carrying rollers. FIG. 3 illustrates a so-called center drive system in which the actual winding-on axle is rotated. In both systems, as the axle 3 rotates paper is wound onto the axle and the axle is removed from the resultant paper roll upon completion of the winding-on process.

Paper rolls with which paper is taken from the center of the roll require a relatively large center opening, about 35–100 mm, which is governed by the other dimensions of the roll. Moreover, most paper rolls intended for taking the paper from the periphery of the roll are provided with center holes with a diameter larger than 35 mm. Winding-on axles of corresponding dimensions are difficult to withdraw from the paper roll wound onto the axle. The friction between roll and axle is particularly great in the case of a fully cylindrical axle, since the abutment surface between paper and axle is then large. Slightly less friction is obtained with axles of a non-circular cross-section. It is therefore proposed in accordance with the invention that a friction-reducing agent is applied to the axle immediately before or in conjunction with initiation of the winding-on process, with the intention of reducing the friction between the paper web and the axle. This agent may consist of water, optionally with an addition of a softener, for instance quaternary amine, or other lubricant, such as silicone or the like. The friction-reducing agent may alternatively consist of an oil, oil emulsion, triglyceride, polytetra-fluoroethylene or the like.

Figure 1:
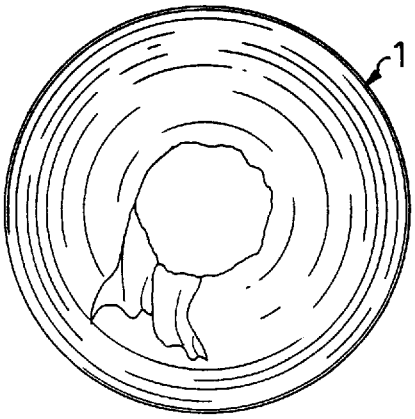
FIG. 1 is an end view of a center-feed paper roll.
Figure 2:
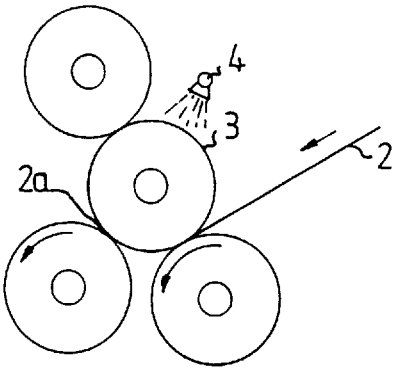
FIGS. 2 and 3 illustrate schematically the initial stage of winding-on a paper web in accordance with two different methods.
Figure 3:
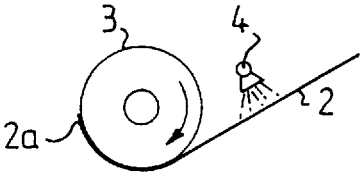

In the FIG. 2 illustration, the friction-reducing agent is applied to the axle 3 with the aid of a spray nozzle 4. It will be understood, however, that the agent can be applied in some other way, for instance it can be brushed onto the axle. Alternatively, the friction-reducing agent can be applied to the innermost turn or turns of the paper web 2 instead of to the axle 3, as illustrated in FIG. 3.

It has been surprisingly found that friction can be reduced substantially with water on its own. This can be explained by the fact that when crêped paper is moistened with water, the paper stretches and remains in a stretched state after having dried. This stretching of the paper reduces the friction between paper and axle. Friction is reduced still further when a softener or some other lubricant is added to the water, as before mentioned. A corresponding reduction in friction is obtained when oil, triglyceride or the like is applied either to the axle or to the innermost turn or turns of the paper web.

Figure 4:
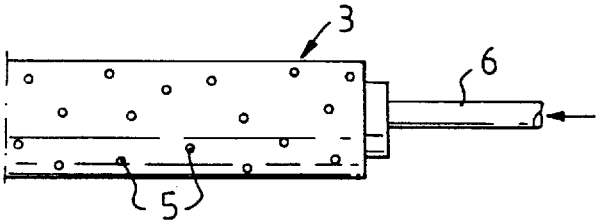
FIG. 4 illustrates an alternative embodiment of a winding-on axle.

Friction is reduced still further when the axle 3 is heated in conjunction with applying the friction-reducing agent. The axle can be heated either electrically or with the aid of steam or some other heating medium, for instance oil. In this latter case, the axle 3 used will preferably be of the kind illustrated in FIG. 4, i.e. a hollow axle or spindle provided with a plurality of radial holes 5. Steam, or water that has been heated electrically within the axle, is applied to the interior of the axle through a pipe 6 and then allowed to flow out through the holes 5. Water applied to the paper in vapor form in this way penetrates the paper web more effectively than water in liquid form.

Heating of the axle, either electrically or with the aid of steam, in combination with moisture supply, results in an ironing effect, i.e. the fibers in the innermost turn or turns of the paper web are compacted and the paper surface abutting the spindle will be smoother, thereby reducing the friction between axle and paper surface. Heating of the axle also accelerates the drying process.

The axle 3 may either be cylindrical, as illustrated in the drawing, or may have some other form which includes teeth, splines or the like, which may optionally be given a helical shape. The axle may also have a slightly conical shape, to facilitate its withdrawal from the paper roll. The axle may consist of a low friction material or may be coated with such a material. Examples of suitable materials are nylon, acetal, polytetra-fluoroethylene or low-friction treated metal alloys.

It will be understood that the invention is not restricted to the described and illustrated exemplifying embodiments thereof and that modifications and changes are conceivable within the scope of the following claims.

I claim:

1. A method of producing a coreless roll from a web of fiber-based material, comprising laying a leading end (2*a*) of a material web directly on a non-expandable winding-on axle (3) which is a part of a winding machine, said axle having a circular cross-section with a diameter of at least 35 mm and rotating the axle so as to wind the web (2) onto said axle; applying (4) a friction-reducing agent in the form of water to the axle or to the first turn or turns of the material web; and withdrawing the axle from the resultant roll upon completion of the web winding-on process, whereby said water reduces friction between the web and the axle during withdrawal of the axle from the roll.

2. A method according to claim 1, and adding surfactant to said water.

3. A method as claimed in claim 1, and heating said axle during winding of the web on the axle.

4. A method according to claim 3, wherein said axle is heated electrically.

5. A method as claimed in claim 1, wherein said axle has a surface of an anti-stick plastic material.

6. A method as claims in claim 1, wherein said axle has a conical outer surface.

7. A method of producing a coreless roll from a web of fiber-based material, comprising laying a leading end (2*a*) of a material web around a non-expandable winding-on axle (3) having a fixed diameter of at least 35 mm and rotating the axle so as to wind the web (2) onto said axle; applying (4) a friction-reducing agent in the form of water to the axle or to the first turn or turns of the material web, thereby to reduce friction between the web and the axle; and withdrawing the axle from the resultant roll after completion of the web winding-on process, further comprising heating the axle by a fluid heating medium introduced within the axle, the axle being hollow and including a plurality of radial holes, said fluid heating medium comprising steam that flows out through said holes to constitute said water.

* * * * *